US010065817B2

(12) United States Patent
Kurohata et al.

(10) Patent No.: US 10,065,817 B2
(45) Date of Patent: Sep. 4, 2018

(54) SHEET FEEDING APPARATUS, IMAGE FORMING APPARATUS, AND IMAGE FORMING SYSTEM

(71) Applicant: Konica Minolta, Inc., Tokyo (JP)

(72) Inventors: Takao Kurohata, Hino (JP); Yuki Yamauchi, Nishitokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/345,815

(22) Filed: Nov. 8, 2016

(65) Prior Publication Data

US 2017/0160688 A1 Jun. 8, 2017

(30) Foreign Application Priority Data

Dec. 3, 2015 (JP) ..... 2015-236606

(51) Int. Cl.
*B65H 1/14* (2006.01)
*B65H 1/04* (2006.01)
(Continued)

(52) U.S. Cl.
CPC ..... *B65H 1/14* (2013.01); *B65H 1/04* (2013.01); *B65H 1/08* (2013.01); *B65H 1/28* (2013.01);
(Continued)

(58) Field of Classification Search
CPC ... B65H 7/02; B65H 7/04; B65H 7/00; B65H 2405/15; B65H 2511/15; B65H 2511/152;
(Continued)

(56) References Cited

U.S. PATENT DOCUMENTS 4,801,135 A * 1/1989 Povio ..... B65H 1/18 271/155
5,435,536 A * 7/1995 Adachi ..... B41J 11/58 271/152
(Continued)

FOREIGN PATENT DOCUMENTS

JP H02-137332 U 11/1990
JP 07-239639 A 9/1995
(Continued)

OTHER PUBLICATIONS

Reasons for Rejection dated Dec. 26, 2017 from corresponding Japanese Application No. JP 2015-236606 and an English translation.

*Primary Examiner* — Ernesto A Suarez
(74) *Attorney, Agent, or Firm* — Lucas & Mercanti, LLP

(57) ABSTRACT

A sheet feeding apparatus includes: a transfer medium loading tray that is movable vertically; a hardware processor configured to control vertical movement of the transfer medium loading tray; an overload detector configured to detect transfer media of a maximum loading amount prescribed for each type of the transfer media; and an intermediate tray position detector configured to detect the transfer medium loading tray being at an intermediate tray position prescribed for each type of the transfer media, wherein the hardware processor is configured to control the vertical movement of the transfer medium loading tray in accordance with a type of the transfer media and on a basis of a vertical position of the transfer medium loading tray, results of detection by the overload detector, and results of detection by the intermediate tray position detector.

20 Claims, 9 Drawing Sheets

(51) Int. Cl.

| | |
|---|---|
| ***B65H 1/08*** | (2006.01) |
| ***B65H 1/28*** | (2006.01) |
| ***B65H 7/02*** | (2006.01) |
| ***G03G 15/00*** | (2006.01) |

(52) U.S. Cl.
CPC ..... *B65H 7/02* (2013.01); *G03G 15/6511* (2013.01); *G03G 15/6529* (2013.01); *B65H 2511/152* (2013.01); *B65H 2511/20* (2013.01); *B65H 2511/414* (2013.01); *B65H 2513/41* (2013.01); *B65H 2601/271* (2013.01); *B65H 2801/06* (2013.01); *G03G 2215/00383* (2013.01)

(58) Field of Classification Search
CPC ..... B65H 2511/11; B65H 2511/10; B65H 2511/416; B65H 2511/182; B65H 2511/24; B65H 2601/271; B65H 1/08; B65H 1/18; B65H 1/20
See application file for complete search history.

(56) References Cited

U.S. PATENT DOCUMENTS

| | | | | |
|---|---|---|---|---|
| 5,794,928 | A * | 8/1998 | Araseki | B65H 1/04 271/126 |
| 6,806,946 | B2 * | 10/2004 | Otaki | B65H 1/14 271/3.14 |
| 8,025,284 | B2 * | 9/2011 | Ikeuchi | B65H 1/14 271/110 |
| 9,199,809 | B2 * | 12/2015 | Hamasaki | B65H 7/06 |
| 2005/0067759 | A1 * | 3/2005 | Koga | B65H 1/14 271/126 |
| 2015/0284195 | A1 * | 10/2015 | Kushida | B65H 1/14 271/152 |
| 2017/0203930 | A1 * | 7/2017 | Yamauchi | B65H 1/04 |

FOREIGN PATENT DOCUMENTS

| | | | |
|---|---|---|---|
| JP | 08-091593 | A | 4/1996 |
| JP | H08-217267 | A | 8/1996 |
| JP | 2011-063344 | A | 3/2011 |

* cited by examiner

SHEET FEEDING APPARATUS, IMAGE FORMING APPARATUS, AND IMAGE FORMING SYSTEM

The entire disclosure of Japanese Patent Application No. 2015-236606 filed on Dec. 3, 2015 including description, claims, drawings, and abstract are incorporated herein by reference in its entirety.

BACKGROUND OF THE INVENTION

Field of the Invention

The present invention relates to a sheet feeding apparatus, an image forming apparatus, and an image forming system that accommodate and feed a transfer medium.

Description of the Related Art

An image forming apparatus that performs printing by forming an image on a transfer medium feeds the transfer medium placed on a tray of a sheet feeding apparatus. The sheet feeding apparatus may be provided inside or outside an image forming apparatus body to feed the transfer medium to the image forming apparatus.

A usable transfer medium is considered for the tray of the sheet feeding apparatus, and the tray is moved vertically by a driving motor corresponding to the usable transfer medium. According to a basic operation of the tray, the tray moves up to an upper limit to take a feedable state. In addition, the tray can be lowered such that the transfer medium can be supplied to the tray. The vertical movement of the tray is performed within a range of assumed loading amount, and is generally restricted in the case where transfer media of an amount exceeding a maximum loading amount are placed on the tray.

JP 7-239639 A discloses giving usability priority and, in replenishing a large capacity cassette with paper sheets, allowing a feeding function to operate even when the paper sheets of an amount equal to or larger than a regulated amount of loading on the tray are loaded on the tray. Specifically, in the case where the paper sheets of an amount equal to or more than the regulated amount of loading are loaded on the tray, a warning screen is displayed regardless of the size of the paper sheets by, when a tray-up switch detects the paper sheets loaded on the tray, stopping lifting of the tray by a motor, enabling feeding of the paper sheets, and, at the same time as turning on of the tray-up switch, display an error message of "please reduce the paper sheets" in the case where a tray-down switch that determines the lowest position of the tray is on.

JP 8-91593 A discloses appropriately restricting the loading by restricting the degree of descent of a sheet feeding tray at the time of loading paper sheets such that a user cannot load the paper sheets exceeding an amount corresponding to the degree of descent of the tray. Specifically, the size of the paper sheets is determined by a sheet size detection unit of a sheet feeding apparatus, a load current value of a tray lifting/lowering motor preset for the size of the paper sheets is extracted, and a current position of the sheet feeding tray is determined by an upper limit detection sensor and a lower limit detection sensor (neither illustrated) of the sheet feeding apparatus. The number of sheets remaining to be loadable and the time of movement to a maximum loading lower limit position are calculated with a prescribed formula, the tray lifting motor is caused to drive for a time extracted by the calculation, the tray is lowered and stopped, and the position is set as the lower limit position corresponding to the maximum loading number of sheets. In this way, the lower limit position of the tray can be changed for each size of the paper sheets.

By the way, generally, a loading amount limit of transfer media is often defined along with usable sizes, and transfer media of a size larger than these are not taken into consideration.

However, there is a demand for expanding the usable sizes of sheets for the sheet feeding apparatus without changing the inner configuration of the sheet feeding apparatus, and a configuration in which a long sheet of a size exceeding the usable sizes can be used is desired. However, in the case where long transfer media of a number equal to or larger than a prescribed number of sheets are loaded, the mass of the transfer media surpasses the performance of a motor provided in the sheet feeding apparatus to lift the sheet feeding tray, and thus the tray cannot be lifted. Therefore, in the case where long transfer media are loaded on the tray, the loading needs to be restricted. In order to avoid this, the power of the motor may be enhanced such that the transfer media can be loaded, but this raises the costs.

SUMMARY OF THE INVENTION

The present invention has been made on the basis of the situation described above, and an object thereof is to provide a sheet feeding apparatus, an image forming apparatus, and an image forming system that enable appropriately restricting the loading of transfer media in accordance with the type of the transfer media.

To achieve the abovementioned object, according to an aspect, a sheet feeding apparatus reflecting one aspect of the present invention comprises:

a transfer medium loading tray that is movable vertically;

a hardware processor configured to control vertical movement of the transfer medium loading tray;

an overload detector configured to detect transfer media of a maximum loading amount prescribed for each type of the transfer media; and an intermediate tray position detector configured to detect the transfer medium loading tray being at an intermediate tray position prescribed for each type of the transfer media, wherein the hardware processor is configured to control the vertical movement of the transfer medium loading tray in accordance with a type of the transfer media and on a basis of a vertical position of the transfer medium loading tray, results of detection by the overload detector, and results of detection by the intermediate tray position detector.

According to another aspect of the present invention, the sheet feeding apparatus preferably further comprises a tray lower-end detector configured to detect the transfer medium loading tray being at a lower end position.

According to another aspect of the present invention, the overload detector is preferably configured to detect whether or not the transfer media exceed the maximum loading amount prescribed for the type of the transfer media via a mass or a loading height when the transfer medium loading tray is at a lower end position.

According to another aspect of the present invention, the overload detector is preferably configured to detect a transfer medium being at an upper limit height position corresponding to a maximum loading height prescribed for the type of the transfer media when the transfer medium loading tray is at a lower end position.

According to another aspect of the present invention, the hardware processor is preferably configured to allow lifting of the transfer medium loading tray in a case where the transfer medium loading tray is at the lower end position and a loading height of the transfer media does not exceed the upper limit height position prescribed for the type of the transfer media.

According to another aspect of the present invention, the hardware processor is preferably configured to prohibit lifting of the transfer medium loading tray in a case where the transfer medium loading tray is at the lower end position and a loading height of the transfer media exceeds the upper limit height position prescribed for the type of the transfer media.

According to another aspect of the present invention, the hardware processor preferably makes a warning when prohibiting the lifting of the transfer medium loading tray.

According to another aspect of the present invention, the intermediate tray position detector is preferably configured to detect, as the transfer medium loading tray being at the intermediate tray position, the transfer medium tray being at a height position equal to or higher than a maximum height position at which a transfer medium loaded on the transfer medium loading tray is capable of being fed in a case where the transfer media are loaded to a maximum loading height corresponding to the type of the transfer media.

According to another aspect of the present invention, the hardware processor is preferably configured to allow lifting of the transfer medium loading tray after stopping descent of the transfer medium loading tray in a case where the overload detector detects that the transfer medium loading tray is not overloaded while the transfer medium loading tray is lowered in accordance with a descent instruction.

According to another aspect of the present invention, the hardware processor is preferably configured to stop the transfer medium loading tray at the intermediate tray position in the lifting.

According to another aspect of the present invention, the hardware processor is preferably configured to restrict a descent position to the intermediate tray position in a case where the transfer medium loading tray is positioned above the intermediate tray position and is lowered in accordance with a descent instruction.

According to another aspect of the present invention, the hardware processor is preferably configured to stop the movement of the transfer medium loading tray and make a warning in a case where the transfer medium loading tray has reached the intermediate tray position.

According to another aspect of the present invention, the hardware processor is preferably configured to control the vertical movement of the transfer medium loading tray on a basis of a descent instruction and in accordance with the transfer media.

According to another aspect of the present invention, the hardware processor is preferably configured to perform a lifting operation of the transfer medium loading tray after lowering the transfer medium loading tray and confirming that the transfer medium loading tray is not overloaded in a case where a lifting instruction of the transfer medium loading tray has been made.

According to another aspect of the present invention, the hardware processor is preferably configured to obtain type information of the transfer media on the transfer medium loading tray via detection of the type of the transfer media or from a type setting in a tray setting.

According to another aspect of the present invention, the hardware processor is preferably configured to make the warning via at least one of display and a sound.

According to another aspect of the present invention, the type of the transfer media is preferably at least one of a size, a basis weight, and a kind of medium of the transfer media.

To achieve the abovementioned object, according to an aspect, an information processing apparatus configured to control a sheet feeding apparatus of an image forming apparatus configured to control vertical movement of a transfer medium loading tray that is movable vertically, reflecting one aspect of the present invention comprises:

a receiver configured to receive results of detection by an overload detector configured to detect transfer media of a maximum loading amount prescribed for each type of the transfer media and results of detection by an intermediate tray position detector configured to detect the transfer medium loading tray being at an intermediate tray position prescribed for each type of the transfer media; and a hardware processor configured to control the vertical movement of the transfer medium loading tray in accordance with a type of the transfer media and on a basis of a vertical position of the transfer medium loading tray, the results of detection by the overload detector, and the results of detection by the intermediate tray position detector.

To achieve the abovementioned object, according to an aspect, an image forming system reflecting one aspect of the present invention comprises:

the information processing apparatus described above;

an image forming unit configured to form an image;

an overload detector; and an intermediate tray position detector.

To achieve the abovementioned object, according to an aspect, a non-transitory recording medium storing a computer readable program reflecting one aspect of the present invention causes a hardware processor of an image forming apparatus configured to control vertical movement of a transfer medium loading tray that is movable vertically to execute:

receiving results of detection by an overload detector configured to detect transfer media of a maximum loading amount prescribed for each type of the transfer media and results of detection by an intermediate tray position detector configured to detect the transfer medium loading tray being at an intermediate tray position prescribed for each type of the transfer media; and controlling the vertical movement of the transfer medium loading tray in accordance with a type of the transfer media and on a basis of a vertical position of the transfer medium loading tray, the results of detection by the overload detector, and the results of detection by the intermediate tray position detector.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 11 is a flowchart illustrating control at the time when a descent switch is on.

DESCRIPTION OF THE PREFERRED EMBODIMENTS

Figure 1:
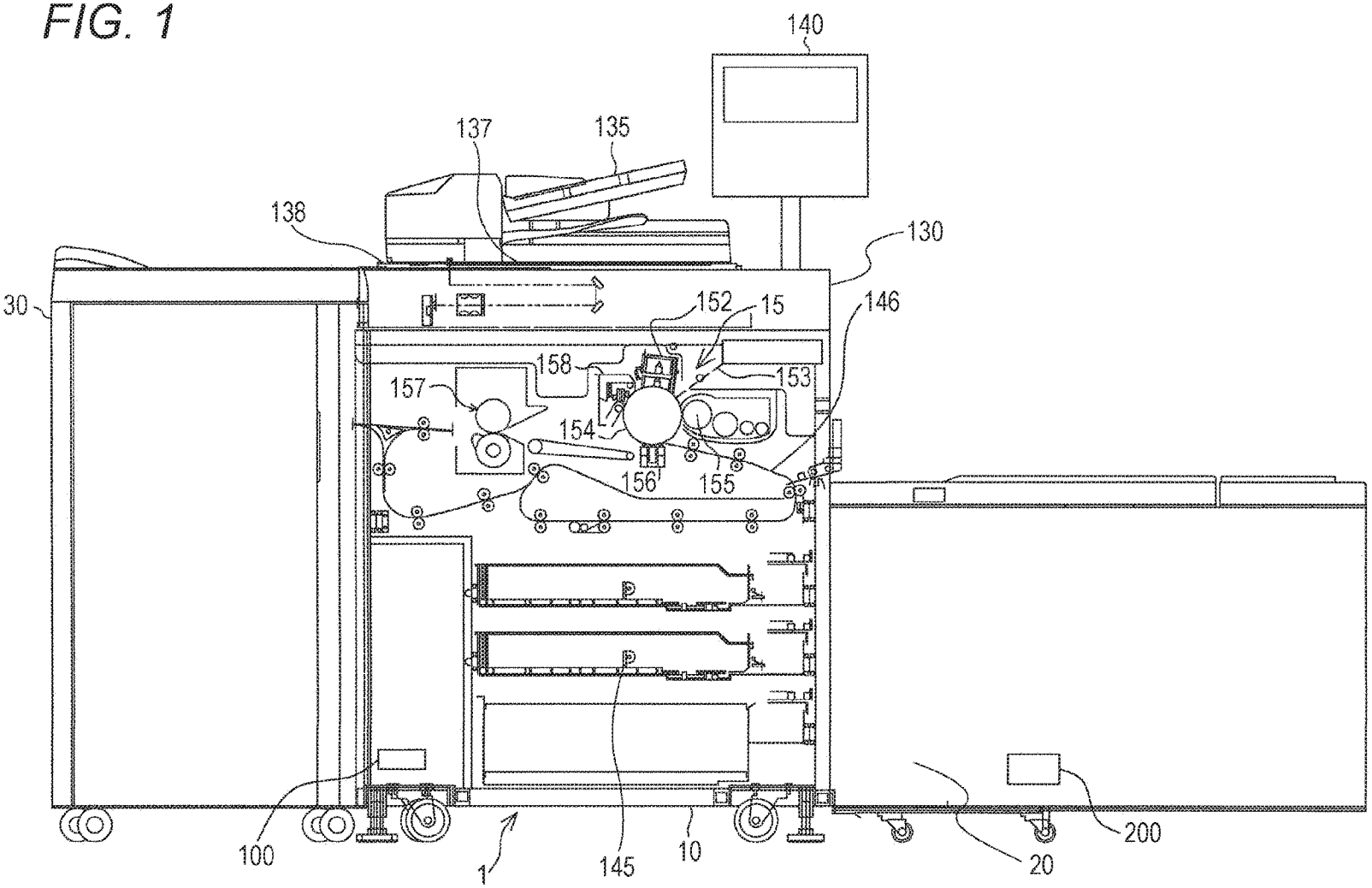
FIG. 1 is a schematic diagram illustrating a section of a part of a sheet feeding apparatus and an image forming system according to an embodiment of the present invention.

Hereinafter, an outline of an image forming system according to an embodiment of the present invention will be described with reference to the drawings. However, the scope of the invention is not limited to the illustrated examples.

In an image forming system 1, a sheet feeding apparatus 20 is connected to the front side of an apparatus body 10, and a finisher 30 is connected to the back side of the apparatus body 10. The apparatus body 10 corresponds to an image forming apparatus.

In the image forming system 1, a paper sheet can be transported between each apparatus, and each apparatus can communicate with each other. The paper sheet corresponds to a transfer medium. In the present invention, other kinds of sheet than paper such as a piece of cloth may be used as the transfer medium.

The image forming system 1 does not have to include the finisher 30, and the image forming apparatus may be constituted by the apparatus body 10 and the sheet feeding apparatus 20.

A scanner unit 130 including a CCD 131 and a flow-in type automatic document feeder (ADF) 135 are provided on the upper side of the apparatus body 10, and an image of a document can be read via platen glass 137 or ADF document reading slit glass 138.

The scanner unit 130, the flow-in type automatic document feeder (ADF) 135, the platen glass 137, and the ADF document reading slit glass 138 described above constitute an image reading unit.

In addition, an operation unit 140 constituted by a touch panel is provided at a portion on the upper side of the apparatus body 10 where the platen glass 137 is not disposed, and an operation by an operator and display of information are thereby enabled. The operation unit 140 serves as an operation unit and also as a display unit of the present invention. According to an aspect of the present invention, the operation unit and the display unit may be configured as different units.

Plural sheet feeding trays (1 to 3) 145 (3-tier in FIG. 1) are disposed in a lower portion of the apparatus body 10, and the sheet feeding apparatus 20 including a sheet feeding tray is attached to the apparatus body 10.

A transportation path 146 for transporting a paper sheet fed from the sheet feeding tray or the sheet feeding apparatus is provided in the apparatus body 10, and an image forming section 15 constituted by a charger 152, an LD 153, a photosensitive member 154, a developing unit 155, a transfer unit 156, a fixing unit 157, a cleaning device 158, and so forth is provided along the transportation path 146 in the apparatus body 10. A transportation path (not illustrated) for transporting each fed paper sheet to introduce the paper sheet to the apparatus body 10 is also provided in the sheet feeding apparatus 20. Further, the finisher 30 transports a paper sheet on which an image has been printed and discharges the paper sheet after or without performing a finishing treatment on the paper sheet.

In the image forming section 15, the charger 152, the developing unit 155, and the transfer unit 156, are disposed around the photosensitive member 154. The photosensitive member 154 corresponds to an image carrier. The charger 152 uniformly charges the surface of the photosensitive member 154 before drawing an image. The LD 153 forms an electrostatic latent image on the photosensitive member 154 by irradiating the photosensitive member 154, whose surface has been uniformly charged, with a semiconductor laser light. The developing unit 155 develops the electrostatic latent image formed on the photosensitive member 154 by the LD 153 with toner material.

A toner image is formed on the photosensitive member 154 via a developing process. The transfer unit 156 transfers the toner image on the photosensitive member 154 onto the paper sheet transported from the sheet feeding trays (1 to 3) 145 or the sheet feeding apparatus 20. The paper sheet onto which the toner image has been transferred is separated from the photosensitive member 154 and transported to the fixing unit 157. The toner material remaining on the photosensitive member 154 is removed by the cleaning device 158.

The fixing unit 157 fixes the toner image transferred onto the front side of the paper sheet by heating the transported paper sheet. The paper sheet on which the fixing treatment has been performed is transported directly to the finisher 30 positioned to the side of the apparatus body 10 in the case of single-sided printing.

The finisher 30 performs finishing treatment such as stapling, punching, and folding.

Meanwhile, in the case of double-sided printing, the paper sheet after fixing is switched back and a prescribed image is transferred onto the back side of the paper sheet at the image forming section 15. Then, the paper sheet on both sides of which images has been formed is transported to the finisher 30 after fixing.

The apparatus body 10 includes an image control unit 100 that controls the apparatus body 10. The image control unit 100 includes a CPU and a program to be executed on the CPU, and further includes a memory unit that stores the program, operation parameters, operation history of the image forming apparatus, and so forth. In addition, the image control unit 100 is capable of controlling the sheet feeding apparatus 20 and the finisher 30.

Figure 2:
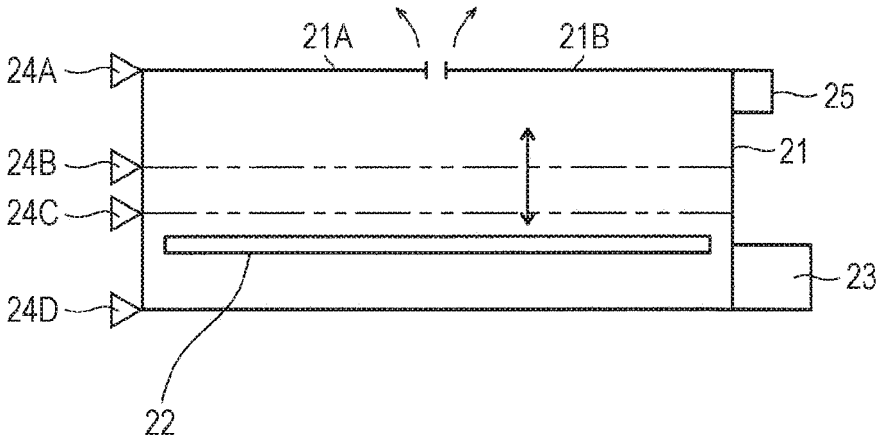
FIG. 2 is a schematic diagram of the sheet feeding apparatus.

Next, the sheet feeding apparatus 20 will be described on the basis of the schematic section view of FIG. 2.

The sheet feeding apparatus 20 includes a body 21 that accommodates paper sheets and, on a top portion of the body 21, covers 21A and 21B that open upward in a double-door manner. The sheet feeding apparatus 20 also may be an apparatus that accommodates pieces of cloth in place of paper sheets. The body 21 can be replenished with paper sheets by opening the covers 21A and 21B.

A sheet loading tray 22 which is capable of moving vertically and on which paper sheets are loaded is provided in the body 21, and is moved vertically by a driving unit 23. The sheet loading tray 22 corresponds to a transfer medium loading tray of the present invention.

In this embodiment, the vertical movement of the sheet loading tray 22 is controlled by a sheet-feeding control unit 200 provided in the sheet feeding apparatus 20. In addition, a descent switch 25 that instructs descent of the sheet loading tray 22 is provided.

In the present invention, the vertical movement may be controlled by the image control unit 100 in the apparatus body 10, and also may be controlled by a management control unit of a management apparatus that manages the image forming system 1. The management apparatus is electrically connected to the apparatus body 10 and so forth via, for example, a network.

The image control unit 100, the sheet-feeding control unit 200, and the management control unit of the management apparatus are each constituted by a CPU, a program to be executed by the CPU, a memory unit, and so forth. The image control unit 100, the sheet-feeding control unit 200, or the management control unit that controls the vertical movement of the sheet loading tray 22 corresponds to a control unit of the present invention.

In addition, an upper limit sensor 24A, a lower limit sensor 24D, an overload detection sensor 24B, and an intermediate-stopping detection sensor 24C are disposed in the apparatus body 21. The upper limit sensor 24A detects a paper sheet positioned at an upper end in preparation for feeding the paper sheet. The lower limit sensor 24D detects the sheet loading tray 22 being positioned at a lower end position. The overload detection sensor 24B detects a paper sheet positioned at a position corresponding to the maximum loading height of paper sheet defined for each type of the paper sheet when the sheet loading tray 22 is at the lower end position. The intermediate-stopping detection sensor 24C detects the sheet loading tray being at a height equally high as or higher than a maximum height position at which the sheet loading tray 22 can feed the paper sheet when the paper sheet is loaded to the maximum loading height corresponding to the type of the paper sheet. In this embodiment, the maximum height position is set as an intermediate tray position.

The overload detection sensor 24B corresponds to an overload detector of the present invention, the intermediate-stopping detection sensor 24C corresponds to an intermediate tray position detector of the present invention, and the lower limit sensor 24D corresponds to a tray lower-end detector of the present invention. Examples of the sensors include a sensor that includes a light emitting portion and a light receiving portion and performs detection by detecting whether or not light is received. However, the detectors suffice as long as the detectors are capable of detecting a detection target, and are not limited to the sensors described above. For example, the overload detector may perform detection by detecting the mass of loaded paper sheets or a load applied to a motor.

Figure 3:
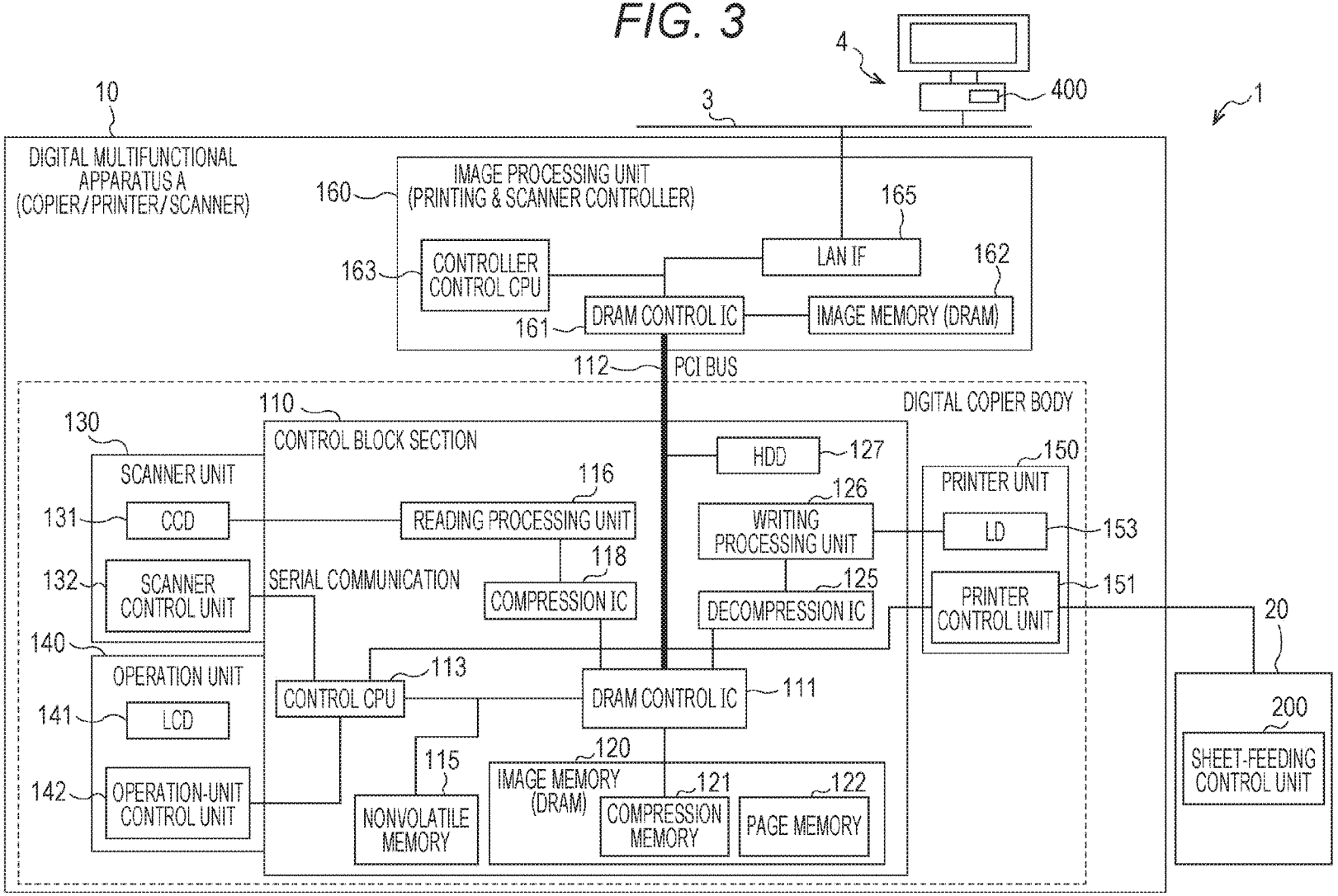
FIG. 3 illustrates a control block unit of the image forming system.

Next, control blocks of the image forming system 1 will be described with reference to FIG. 3.

The apparatus body 10 of the image forming system 1 includes a digital copier body including a control block section 110, the scanner unit 130, the operation unit 140, and a printer unit 150 as main components and an image processing unit (printing & scanner controller) 160 that processes image data communicated between the image forming system 1 and an external apparatus 4 (e.g. a terminal (PC)) via a LAN 3.

The control block section 110 includes a PCI bus 112, and the PCI bus 112 is connected to a DRAM control IC 111 in the control blocks. In addition, an HDD 127 is connected to the PCI bus 112. The HDD 127 is capable of storing identification information, sheet feeding tray settings, and so forth associated with a job.

Further, the control block section 110 includes a control CPU 113, and a nonvolatile memory 115 is connected to the control CPU 113. The nonvolatile memory 115 stores a program to operate the control CPU 113, setting data for the image forming system 1, a process control parameter, and so forth.

The control CPU 113 is provided for knowing the overall condition of the image forming system 1, and performs, for example, image formation control. In addition, the control CPU 113 may control the sheet feeding apparatus 20. In this case, the control CPU 113 functions as a control unit of the present invention.

The scanner unit 130 includes a CCD 131 and a scanner control unit 132. The CCD 131 performs optical reading, and the scanner control unit 132 performs overall control of the scanner unit 130. The scanner control unit 132 is connected to the control CPU 113 so as to be communicable via serial communication, and is controlled by the control CPU 113. The scanner control unit 132 may be constituted by a CPU and a program for operating the CPU. Image data read by the CCD 131 is processed by a reading processing unit 116.

The operation unit 140 includes an LCD 141 and an operation-unit control unit 142, and the LCD 141 and the operation-unit control unit 142 are connected to each other. The operation-unit control unit 142 is connected to the control CPU 113 so as to be communicable via serial communication. According to the configuration above, the operation unit 140 is controlled by the control CPU 113. The operation-unit control unit 142 may be constituted by a CPU and a program for operating the CPU.

The operation unit 140 is capable of inputting operation control conditions for the image forming system 1 such as settings for image formation or sheet feeding and operation instruction. Further, the operation unit 140 is capable of, for example, displaying contents of settings, condition of the machine, and information, and is controlled by the control CPU 113. One can perform prescribed operations and so forth via the operation unit 140.

In addition, the DRAM control IC 111 is connected to an image memory (DRAM) 120 including a compression memory 121 and a page memory 122. The image memory (DRAM) 120 stores, as job data, image data obtained by the scanner unit 130 or through the LAN 3 and identification information associated with an image. The job data including the image data and the identification information also may be stored in the HDD 127. Plural pieces of job data may be stored as stored jobs.

The DRAM control IC 111 is connected to a compression IC 118 and a decompression IC 125. The compression IC 118 compresses image data and the decompression IC 125 decompresses the image data. The DRAM control IC 111 is further connected to a writing processing unit 126 via the decompression IC 125. The writing processing unit 126 is connected to the LD 153 of the printer unit 150, and processes data used for the operation of the LD 153.

In addition, the printer unit 150 includes a printer control unit 151 that performs overall control of the printer unit 150, and the printer control unit 151 is electrically connected to the control CPU 113 to be controlled by the control CPU 113. The printer control unit 151 performs various control of the printer unit 150 in accordance with an instruction from the control CPU 113.

The printer control unit 151 is electrically connected to the sheet-feeding control unit 200 that controls a sheet feeding unit large capacity tray. The printer control unit 151 instructs the sheet-feeding control unit 200 to feed a sheet in response to an instruction from the control CPU 113.

In addition, a DRAM control IC 161 of the image processing unit (printing & scanner controller) 160 described above is connected to the PCI bus 112 connected to the DRAM control IC 111. In the image processing unit (printing & scanner controller) 160, an image memory 162 and a LAN interface 165 are connected to the DRAM control IC 161. The LAN interface 165 is connected to the LAN 3. Various networks may be used as the LAN 3.

The external apparatus 4 such as a PC terminal and a management apparatus is connected to the LAN 3, and image data and identification information may be communicated between the external apparatus 4 and the image forming system 1. The external apparatus 4 includes an external apparatus control unit 400 that performs overall control of the external apparatus 4. In the case where the external apparatus 4 is used as the management apparatus, the external apparatus control unit 400 functions as a management control unit.

Figure 4:
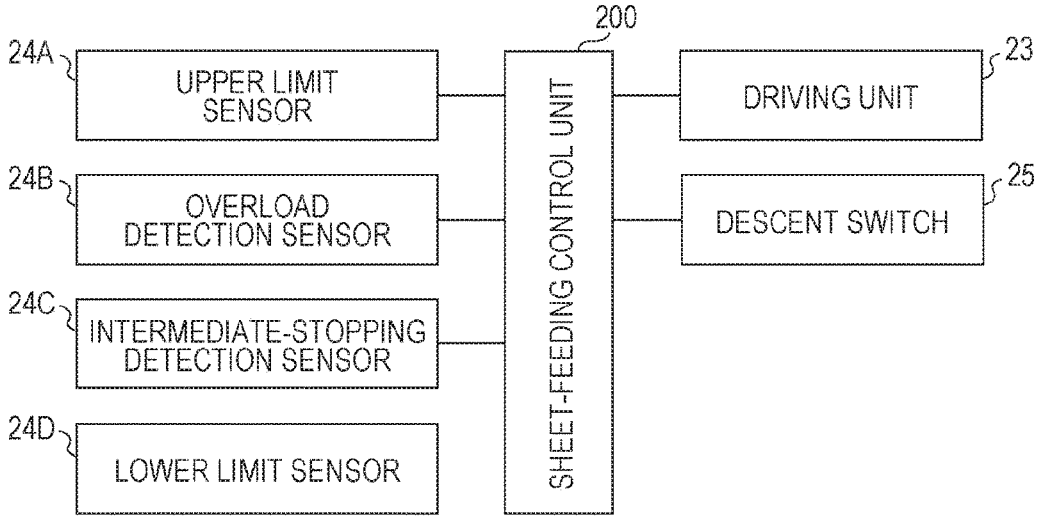
FIG. 4 illustrates a control block unit of the sheet feeding apparatus.

FIG. 4 illustrates a block diagram of the sheet feeding apparatus 20.

The sheet feeding apparatus 20 includes the sheet-feeding control unit 200 that performs overall control of the sheet feeding apparatus 20. The driving unit 23 and the descent switch 25 are connected to the sheet-feeding control unit 200, and the driving unit 23 is controlled by the sheet-feeding control unit 200 to move the sheet loading tray 22 vertically. For example, a motor may be used as the driving unit 23. Operation input of the descent switch 25 is notified to the sheet-feeding control unit 200, and a descent operation is performed by the driving unit 23.

In addition, the upper limit sensor 24A, the overload detection sensor 24B, the intermediate-stopping detection sensor 24C, and the lower limit sensor 24D are controllably connected to the sheet-feeding control unit 200, and the results of detection by each sensor are to be transmitted to the sheet-feeding control unit 200.

Next, the basic operation of the image forming system 1 will be described.

First, processes of accumulating image data in the image forming system 1 will be described. In the image forming system 1, in the case where the scanner unit 130 reads an image of a document to generate image data, the scanner unit 130 optically reads the image of the document by using the CCD 131. In this case, the operation of the CCD 131 is controlled by the scanner control unit 132 that receives an instruction from the control CPU 113. The image data read by the CCD 131 is processed by the reading processing unit 116, and the processed image data is compressed by the compression IC 118 and stored on the compression memory 121 or the HDD 127 via the DRAM control IC 111. The image data stored in the compression memory 121 or the HDD 127 can be managed as a job by the control CPU 113.

In the case where the image data is obtained from the outside, for example, image data is transmitted from the external apparatus 4 through the LAN 3 and stored on the image memory 162 by the DRAM control IC 161 via the LAN interface 165. At this time, printing information can be also received simultaneously. In the case where the image data on the image memory 162 requires raster image processing (RIP), the image data is converted into a bitmap by a controller control CPU 163, and then is stored again on the image memory 162. In the case where plural jobs are assigned for templates in the outside, a page position and image data based on the job are associated with each other and input to the image processing unit (printing & scanner controller) 160.

The data on the image memory 162 is temporally stored on the page memory 122 via the DRAM control IC 161, the PCI bus 112, and the DRAM control IC 111. The data stored on the page memory 122 is transmitted to the compression IC 118, sequentially compressed, stored on the compression memory 121 or the HDD 127 via the DRAM control IC 111, and managed by the control CPU 113 in a similar manner as described above.

Subsequently, in the case where an image is to be output from the image forming system 1, the image data and the printing information stored on the compression memory 121 or the HDD 127 are transmitted to the decompression IC 125 via the DRAM control IC 111, the data is decompressed, the decompressed data is transmitted to the writing processing unit 126, and writing on each photosensitive member is performed by the LD 153. A paper sheet on which printing is performed at the image forming section 15 is discharged through the transportation path 146. The paper sheet discharged from the apparatus body 10 is subjected to a desired finishing treatment by the finisher 30 as necessary. In the case where no finishing treatment is needed, the paper sheet is directly discharged.

Next, the operation of the sheet feeding apparatus 20 will be described.

In the sheet feeding apparatus 20, the sheet loading tray 22 descends by pressing the descent switch 25. Since the structure of the sheet feeding apparatus 20 requires opening the covers 21A and 21B to supply paper sheets through the top surface and it will be difficult to add or replace the paper sheets if the sheet loading tray 22 is configured to descend to the lower limit in response to opening the covers, the sheet loading tray 22 is configured such that a user lowers the sheet loading tray 22 by using the descent switch 25.

In feeding the paper sheet, the sheet loading tray 22 is prepared for the feeding by lifting the sheet loading tray 22 such that the uppermost paper sheet is positioned at the upper limit.

In the sheet feeding apparatus 20, the results of detection by each sensor are transmitted to the sheet-feeding control unit 200, and the sheet-feeding control unit 200 determines the vertical movement of the sheet loading tray 22 on the basis of the results of detection.

The sheet-feeding control unit 200 is capable of determining whether or not the paper sheet has reached the upper limit position in the lifting of the sheet loading tray 22 on the basis of the results of detection by the upper limit sensor 24A, and is capable of stopping the upward movement of the sheet loading tray 22 to prepare for the feeding when the paper sheet has reached the upper limit position.

The sheet-feeding control unit 200 is capable of determining whether or not the sheet loading tray 22 is at the lower end position on the basis of the results of detection by the lower limit sensor 24D. When the lower limit sensor 24D detects the sheet loading tray 22 having reached the lower end position during the descent of the sheet loading tray 22, the sheet-feeding control unit 200 stop the descent of the sheet loading tray 22. The sheet-feeding control unit 200 is also capable of performing control to cause the sheet loading tray 22 to move upward as necessary.

The sheet-feeding control unit 200 is capable of determining whether or not the paper sheet is overloaded on the basis of the results of detection by the overload detection sensor 24B and the position of the sheet loading tray 22.

The sheet-feeding control unit 200 is capable of determining whether or not the sheet loading tray 22 is at the set intermediate tray position in accordance with the results of detection by the intermediate-stopping detection sensor 24C. The sheet-feeding control unit 200 is capable of stopping the descent of the sheet loading tray 22 in the case where the sheet loading tray 22 has descended to reach the intermediate tray position.

The sheet-feeding control unit 200 is capable of detecting the vertical position of the sheet loading tray 22 on the basis of the results of detection by each sensor or driving signal of the driving unit 23. A sensor for detecting the vertical position may be provided additionally.

The sheet-feeding control unit 200 is capable of determining a vertical position relative to a position detected by the overload detection sensor 24B, a vertical position relative to a position detected by the intermediate-stopping detection sensor 24C, the lower end position for the lower limit sensor 24D, and so forth from the results of detection by each sensor.

Next, operation conditions of the sheet loading tray 22 by the sheet-feeding control unit 200 will be described on the basis of FIGS. 5A to 8. The operations below are executed in the case where a prescribed type of paper sheet (e.g. a long paper sheet) P has been detected being placed on the sheet loading tray 22 or in the case where a prescribed type of paper sheet P is set for the sheet loading tray 22 in sheet-feeding-tray settings.

Figure 5A:
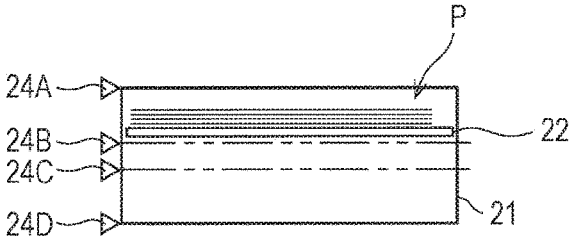
FIGS. 5A and 5B are schematic diagrams illustrating an operation state of a sheet loading tray.
Figure 5B:
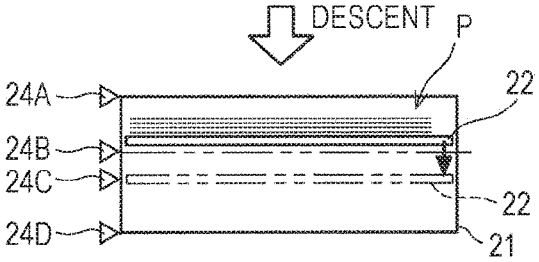

FIGS. 5A and 5B illustrate an operation of a case where the sheet loading tray 22 is above the intermediate tray position.

In the case where the sheet loading tray 22 is positioned above the intermediate tray position and a descent has been instructed (FIG. 5A), the sheet loading tray 22 descends and, once the intermediate-stopping detection sensor 24C has detected the sheet loading tray 22, the sheet-feeding control unit 200 stops the descent of the sheet loading tray 22 and displays a warning message on the operation unit 140. The warning may be made by not only by displaying on a screen but also via a sound, or notified to another apparatus through a network. The warning can indicate that the descent of the sheet loading tray 22 is limited to the intermediate tray position. After that, the sheet loading tray 22 may be remain still or lifted in preparation for sheet feeding. By limiting the position of descent of the sheet loading tray 22 to the intermediate tray position, the amount of paper sheet loaded on the sheet loading tray 22 can be kept equal to or smaller than the maximum loading amount even when, for example, the paper sheet is replenished, and the sheet loading tray 22 can operate appropriately.

In the case where the sheet loading tray 22 is below the intermediate tray position (FIG. 6A), a descent operation is performed temporally even when a lifting instruction has been made. This is because whether or not the paper sheet is overloaded cannot be determined in the case where the sheet loading tray 22 is below the intermediate tray position except for in the case where the loading height of the paper sheet is lower than the maximum loading height.

Figure 6A:
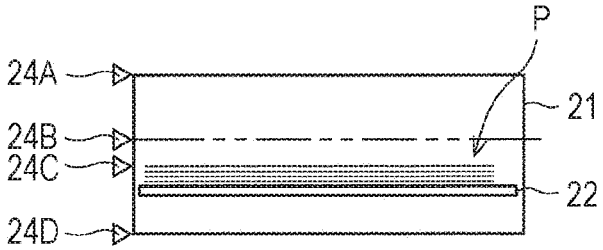
FIGS. 6A to 6D are schematic diagrams illustrating an operation state of the sheet loading tray.
Figure 6B:
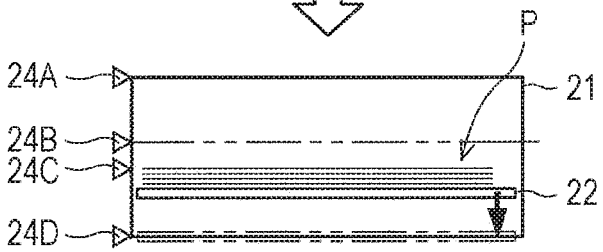

Although the loading height of the paper sheet is lower than the maximum loading height in FIG. 6A, the sheet loading tray 22 is lowered as it is (FIG. 6B).

Figure 6C:
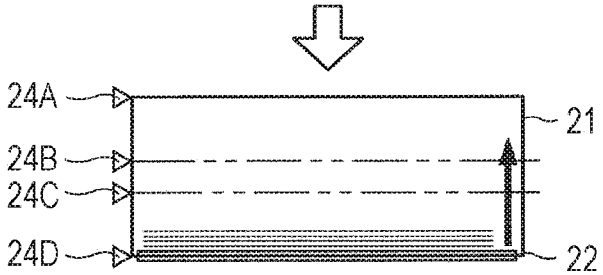

In a state where the sheet loading tray 22 has reached the lower end, whether the paper sheet reaches the maximum loading height is detected by the overload detection sensor 24B. In the case where the paper sheet has not reached the maximum height, lifting of the sheet loading tray 22 is allowed (FIG. 6C).

Figure 6D:
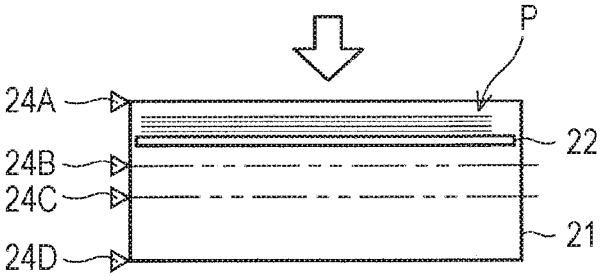

When the sheet loading tray 22 is lifted in accordance with the lifting allowance, the uppermost paper sheet is detected by the upper limit sensor 24A, and the lifting of the sheet loading tray 22 is stopped (FIG. 6D).

Figure 7A:
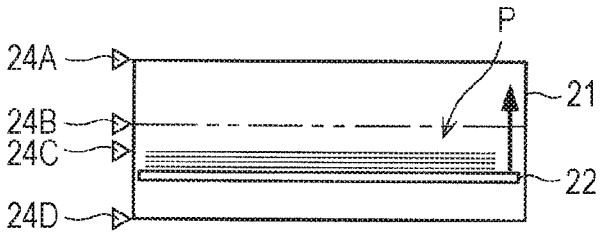
FIGS. 7A to 7D are schematic diagrams illustrating an operation state of the sheet loading tray.

In addition, in the case where the sheet loading tray 22 is positioned below the intermediate tray position (FIGS. 7A, 7B, and 7C) and the paper sheet has not been detected by the overload detection sensor 24B at that time, the amount of loaded paper sheet has not reached the maximum loading amount, and the lifting of the sheet loading tray 22 is thus allowed (FIG. 7A).

Figure 7B:
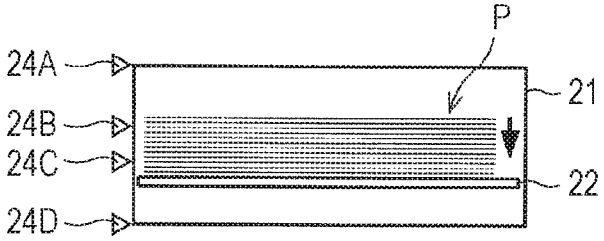
Figure 7C:
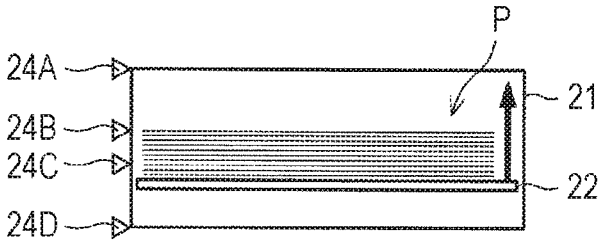

In the case where the sheet loading tray 22 is positioned below the intermediate tray position and a descent instruction has been made (FIGS. 7A, 7B, and 7C), the descent is continued when the overload detection sensor 24B detects a paper sheet and does not detect the uppermost paper sheet (FIG. 7B). Then, once the uppermost paper sheet placed on the sheet loading tray 22 is detected by the overload detection sensor 24B during the descent (FIG. 7C), the lifting is allowed because the paper sheet is equal to or less than the maximum loading amount. In this case, the descent may be stopped and the lifting may be performed thereafter. A screen indicating that the sheet feeding apparatus 20 is in a feedable state may be displayed on, for example, the operation unit 140, and the sheet loading tray 22 may stand by for a lifting operation. Alternatively, the descent may be continued.

Figure 7D:
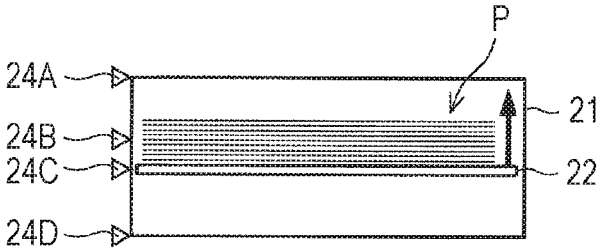
Figure 8:
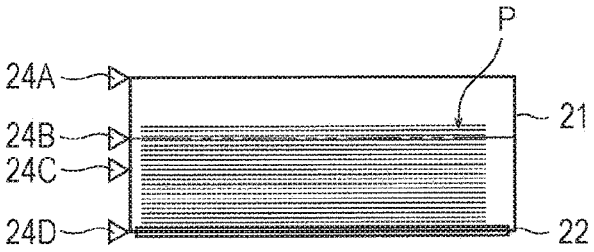
FIG. 8 is a schematic diagram illustrating an operation state of the sheet loading tray.

In the lifting, the lifting of the sheet loading tray 22 may be stopped such that the sheet loading tray 22 is positioned at the intermediate tray position (FIG. 7D). By positioning the sheet loading tray 22 at the intermediate tray position, the paper sheet can be appropriately loaded on the sheet loading tray 22. Alternatively, the sheet loading tray 22 may be lifted to a feeding position after waiting for a lifting instruction.

When the descent of the sheet loading tray 22 is continued and the sheet loading tray 22 is detected by the lower limit sensor 24D, the descent of the sheet loading tray 22 is stopped. In the case where the paper sheet is detected by the overload detection sensor 24B and the height of the paper sheet is higher than the overload detection position at this time (FIG. 8), a warning message is notified via a screen on the operation unit 140 or via a sound. In this case, the lifting of the sheet loading tray 22 is prohibited because the sheet loading tray 22 is overloaded. In addition, in the case where the uppermost paper sheet has not been detected by the overload detection sensor 24B when the sheet loading tray 22 is at the lower end position, the lifting is reinforced because the sheet loading tray 22 is not overloaded.

Figure 9:
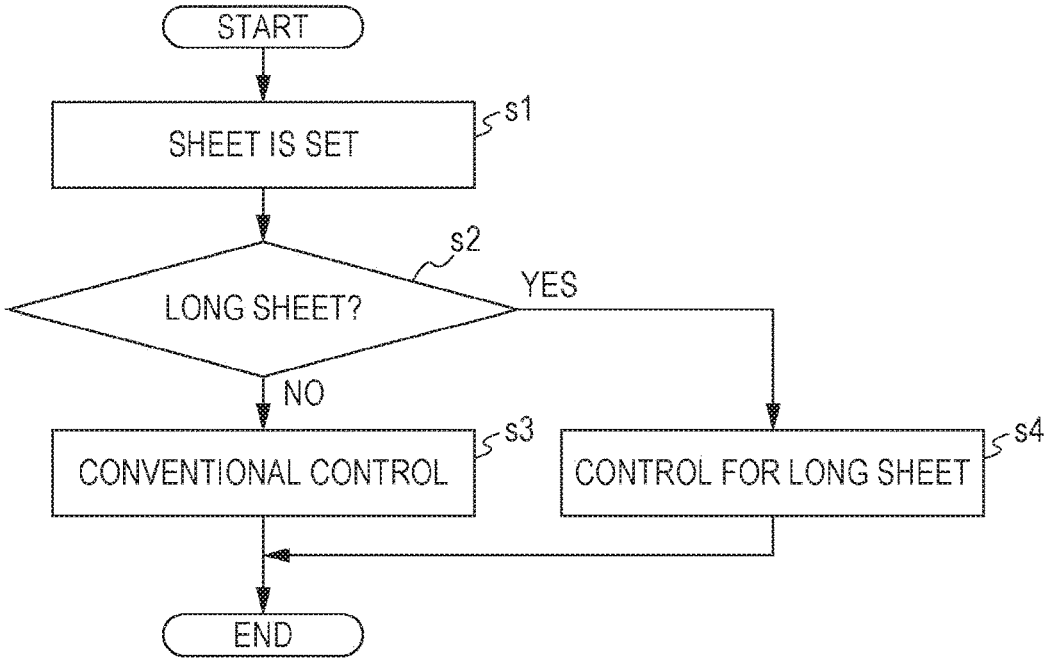
FIG. 9 is a flowchart illustrating control performed in accordance with a type of a transfer medium in sheet feeding control.
Figure 10:
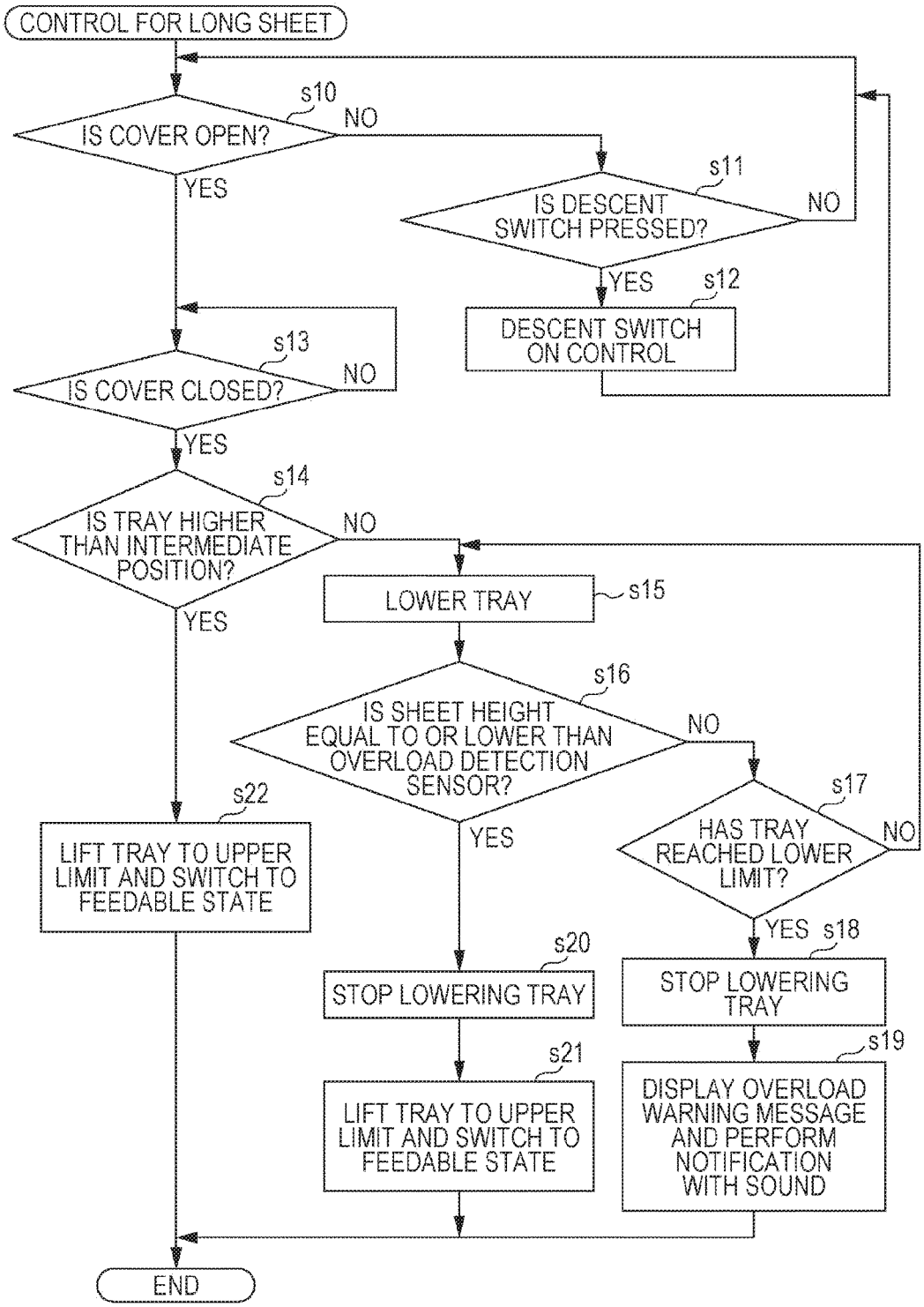
FIG. 10 is a flowchart illustrating control for a long sheet.
Figure 11:
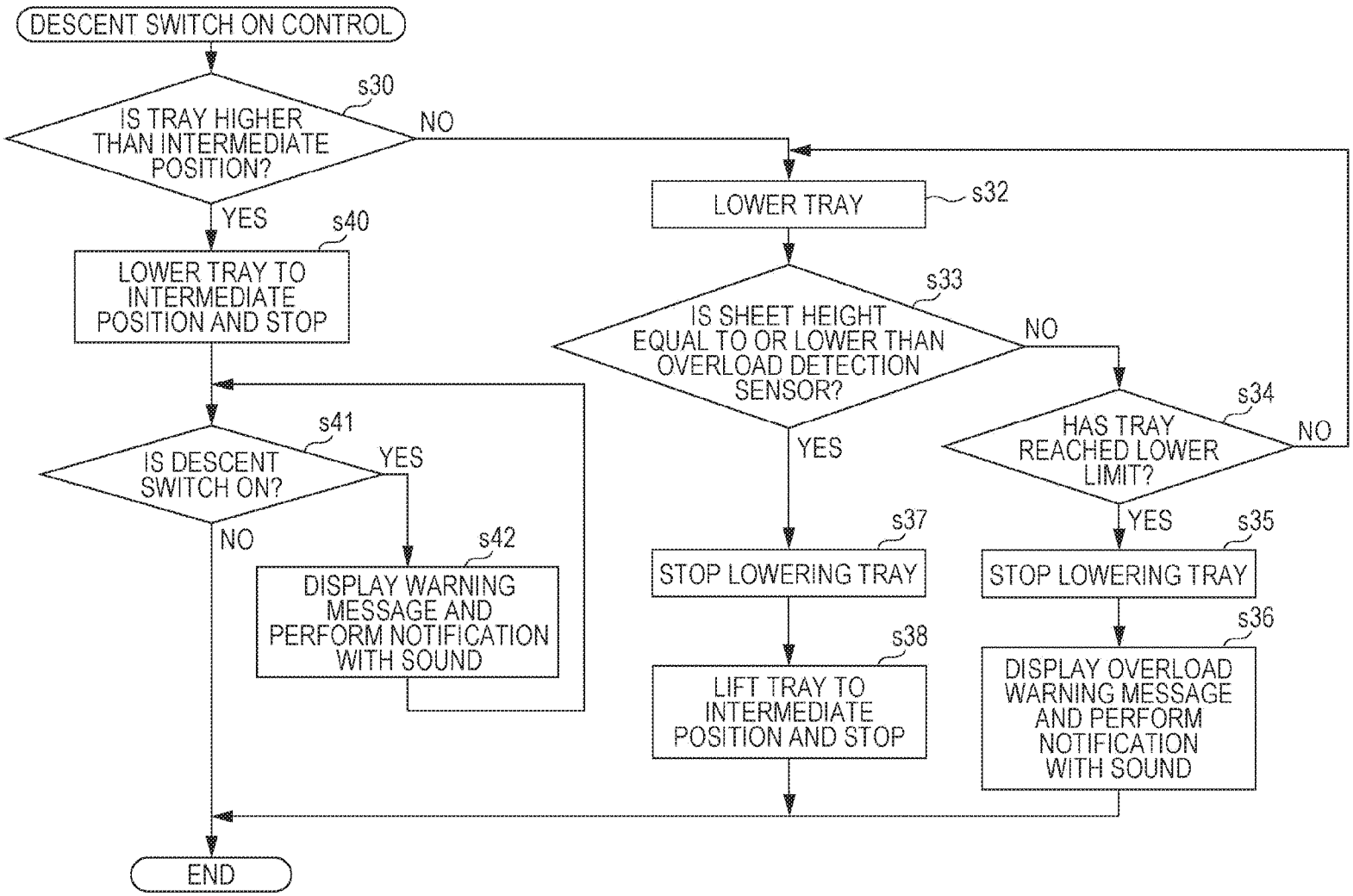

Next, control steps of the sheet feeding apparatus 20 will be described on the basis of flowcharts of FIGS. 9 to 11. The steps below are executed via control by the sheet-feeding control unit 200.

First, along with the start of sheet feeding control, the paper sheet is set on the sheet loading tray 22 serving as a target (step s1), and whether or not the paper sheet is a prescribed long paper sheet is determined (step s2). In the case where the paper sheet is not the prescribed long paper sheet (step s2: No), conventional control is executed (step s3), and the process ends. In the case where the paper sheet is the prescribed long paper sheet (step s2: Yes), control for the long paper sheet is executed (step s4), and the process ends.

The prescribed long paper sheet may be defined beforehand, and a paper sheet of a size exceeding a size for which conventional control is performed may be specified as the long paper sheet. The settings for the long paper sheet may be stored on a nonvolatile memory unit provided in the sheet-feeding control unit 200, and may be read out for using the determination as necessary. Alternatively, the settings for the prescribed long paper sheet may be variable.

Next, details of control for the long paper sheet will be described on the basis of the flowchart of FIG. 10. The steps below are executed via control by the sheet-feeding control unit 200.

First, whether or not the covers 21A and 21B of the sheet feeding apparatus 20 is open is determined (step s10). Opening and closing of the covers 21A and 21B can be determined via detection by an appropriate sensor and by notifying the results of the detection to the sheet-feeding control unit 200.

In the case where the covers 21A and 21B are not open (step s10: No), whether or not the descent switch 25 is pressed is determined (step s11). In the case where the descent switch 25 is not pressed (step s11: No), the process returns to step s10 and the determination whether or not the covers 21A and 21B are open is performed. In the case where the descent switch 25 is pressed (step s11: Yes), control for turning the descent switch 25 on is performed (step s12), and then the process returns to step s10 and the determination whether or not the covers 21A and 21B are open is performed.

In the case where the covers 21A and 21B are open (step s10: Yes), whether or not the covers 21A and 21B are closed is determined (step s13), and, in the case where the covers 21A and 21B are not closed (step s13: No), closing of the covers 21A and 21B is waited for.

Once the covers 21A and 21B are closed (step s13: Yes), whether or not the sheet loading tray 22 is positioned above the intermediate tray position is determined on the basis of the results of detection by the intermediate-stopping detection sensor 24C (step s14).

In the case where the sheet loading tray 22 is not positioned below the intermediate tray position (step s14: No), the sheet loading tray 22 is lowered (step s15), and whether or not the height of the paper sheet is equal to or lower than the height of the overload detection sensor 24B is determined (step s16). In the case where the height of the paper sheet is not equal to or lower than the overload height (step s16: No), whether or not the sheet loading tray 22 has reached the lower limit is determined (step s17). In the case where the sheet loading tray 22 has not reached the lower limit (step s17: No), the process returns to step s15, and the descent of the sheet loading tray 22 is continued.

In the case where the sheet loading tray 22 has reached the lower limit (step s17: Yes), the descent of the sheet loading tray 22 is stopped (step s18), an overload warning message is displayed and notification is made via a sound (step s19), and the process ends.

In the case where the height of the paper sheet is equal to or lower than the overload detection sensor 24B in step s16 (step s16: Yes), the descent of the sheet loading tray 22 is stopped (step s20), the sheet loading tray 22 is lifted to the upper limit on the basis of the results of detection by the upper limit sensor 24A, a feedable state is taken (step s21), and the process ends.

Meanwhile, in the case where the sheet loading tray 22 is positioned above the intermediate tray position (step s14: Yes), the sheet loading tray 22 is lifted to the upper limit on the basis of the upper limit sensor 24A, the feedable state is taken (step s22), and the process ends.

Next, details of control for turning the descent switch 25 on will be described on the basis of the flowchart of FIG. 11. The steps below are executed via control by the sheet-feeding control unit 200.

First, whether or not the sheet loading tray 22 is positioned above the intermediate tray position is determined on the basis of the results of detection by the intermediate-stopping detection sensor 24C (step s30). In the case where the sheet loading tray 22 is not positioned above the intermediate tray position (step s30: No), the sheet loading tray 22 is lowered (step s32), and whether or not the height of the paper sheet is equal to or lower than the height of the overload detection sensor 24B is determined on the basis of the results of detection by the overload detection sensor 24B (step s33). In the case where the height of the paper sheet is not equal to or lower than the overload height (step s33: No), whether or not the sheet loading tray 22 has reached the lower limit is determined on the basis of the results of detection by the lower limit sensor 24D (step s34). In the case where the sheet loading tray 22 has not reached the lower limit (step s34: No), the process returns to step s32, and the descent of the sheet loading tray 22 is continued.

In the case where the sheet loading tray 22 has reached the lower limit (step s34: Yes), the descent of the sheet loading tray 22 is stopped (step s35), an overload warning message is displayed and notification is made via a sound (step s36), and the process ends.

In the case where the height of the paper sheet is equal to or lower than the overload detection sensor 24B in step s33 (step s33: Yes), the descent of the sheet loading tray 22 is stopped (step s37), the sheet loading tray 22 is stopped after being lifted to the intermediate tray position while performing detection by the intermediate-stopping detection sensor 24C (step s38), and the process ends.

In the case where the sheet loading tray 22 is positioned above the intermediate tray position (step s30: Yes), the sheet loading tray 22 is stopped after being lowered to the intermediate tray position on the basis of the results of detection by the intermediate-stopping detection sensor 24C (step s40), and whether or not the descent switch 25 is on is determined (step s41). In the case where the descent switch 25 is on (step s41: Yes), a warning message is displayed and notification is made via a sound (step s42), the process returns to steps s41, and whether or not the descent switch 25 is on is determined.

In the case where the descent switch 25 is not on (step s41: No), the process ends.

As described above, according to the present embodiment, in the case where the paper sheet is a long paper sheet, the descent of a sheet feeding tray by a descent switch is stopped at an intermediate-stopping detection sensor position, and a warning message is displayed. In the case where the sheet feeding tray is stopped below the intermediate-stopping detection sensor position, the sheet feeding tray is lowered to a lower limit sensor position, and whether or not the sheet feeding tray is overloaded is checked by an overload detection sensor. In the case where the sheet feeding tray is overloaded, a warning message is displayed, and the paper sheet is removed. In the case where the sheet feeding tray is not overloaded, an appropriate restriction of the loading is performed by lifting the sheet feeding tray to the intermediate-stopping sensor position.

Although the vertical movement of the sheet loading tray 22 has been described to be controlled by the sheet-feeding control unit 200 according the embodiment described above, the movement may be controlled by the image control unit 100 of the apparatus body 10, and the image control unit 100 and the sheet-feeding control unit 200 may cooperatively function as the control unit of the present invention.

Further, the vertical movement of the sheet loading tray 22 may be controlled by the management control unit of the management apparatus connected to the image forming apparatus.

The embodiment of the present invention has been described above, and the embodiment may be appropriately modified in the scope of the present invention.

According to an embodiment of the present invention, the loading of transfer media for a sheet feeding apparatus can be appropriately restricted in accordance with the type of the transfer media, and the usable sizes can be expanded without changing the inner configuration of the sheet feeding apparatus.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet feeding apparatus comprising:

a transfer medium loading tray that is movable vertically;

a hardware processor configured to control vertical movement of the transfer medium loading tray;

an overload detector configured to detect transfer media of a maximum loading amount prescribed for each type of the transfer media;

a tray lower-end detector configured to detect the transfer medium loading tray being at a lower end position; and an intermediate tray position detector configured to detect the transfer medium loading tray being at an intermediate tray position prescribed for each type of the transfer media, wherein the hardware processor is configured to control the vertical movement of the transfer medium loading tray in accordance with a type of the transfer media and on a basis of a vertical position of the transfer medium loading tray, results of detection by the overload detector, and results of detection by the intermediate tray position detector, and the hardware processor is configured to determine that the transfer medium is overloaded by detecting, using the intermediate tray position detector, that the vertical position of the transfer medium loading tray is not above the intermediate tray position, then lowering the transfer medium loading tray toward the lower end position, and detecting, by the overload detector, the transfer media of the maximum loading amount when the transfer medium loading tray reaches the lower end position.

2. The sheet feeding apparatus according to claim 1, wherein the overload detector is configured to detect whether or not the transfer media exceed the maximum loading amount prescribed for the type of the transfer media via a mass or a loading height when the transfer medium loading tray is at a lower end position.

3. The sheet feeding apparatus according to claim 1, wherein the overload detector is configured to detect a transfer medium being at an upper limit height position corresponding to a maximum loading height prescribed for the type of the transfer media when the transfer medium loading tray is at a lower end position.

4. The sheet feeding apparatus according to claim 3, wherein the hardware processor is configured to allow lifting of the transfer medium loading tray in a case where the transfer medium loading tray is at the lower end position and a loading height of the transfer media does not exceed the upper limit height position prescribed for the type of the transfer media.

5. The sheet feeding apparatus according to claim 3, wherein the hardware processor is configured to prohibit lifting of the transfer medium loading tray in a case where the transfer medium loading tray is at the lower end position and a loading height of the transfer media exceeds the upper limit height position prescribed for the type of the transfer media.

6. The sheet feeding apparatus according to claim 5, wherein the hardware processor makes a warning when prohibiting the lifting of the transfer medium loading tray.

7. The sheet feeding apparatus according to claim 1, wherein the intermediate tray position detector is configured to detect, as the transfer medium loading tray being at the intermediate tray position, the transfer medium tray being at a height position equal to or higher than a maximum height position at which a transfer medium loaded on the transfer medium loading tray is capable of being fed in a case where the transfer media are loaded to a maximum loading height corresponding to the type of the transfer media.

8. The sheet feeding apparatus according to claim 7, wherein the hardware processor is configured to allow lifting of the transfer medium loading tray after stopping descent of the transfer medium loading tray in a case where the overload detector detects that the transfer medium loading tray is not overloaded while the transfer medium loading tray is being lowered in accordance with a descent instruction.

9. The sheet feeding apparatus according to claim 4, wherein the hardware processor is configured to stop the transfer medium loading tray at the intermediate tray position in the lifting.

10. The sheet feeding apparatus according to claim 7, wherein the hardware processor is configured to restrict a descent position to the intermediate tray position in a case where the transfer medium loading tray is positioned above the intermediate tray position and is lowered in accordance with a descent instruction.

11. The sheet feeding apparatus according to claim 9, wherein the hardware processor is configured to stop the movement of the transfer medium loading tray and make a warning in a case where the transfer medium loading tray has reached the intermediate tray position.

12. The sheet feeding apparatus according to claim 1, wherein the hardware processor is configured to control the vertical movement of the transfer medium loading tray on a basis of a descent instruction and in accordance with the transfer media.

13. The sheet feeding apparatus according to claim 1, wherein the hardware processor is configured to perform a lifting operation of the transfer medium loading tray after lowering the transfer medium loading tray and confirming that the transfer medium loading tray is not overloaded in a case where a lifting instruction of the transfer medium loading tray has been made.

14. The sheet feeding apparatus according to claim 1, wherein the hardware processor is configured to obtain type information of the transfer media on the transfer medium loading tray via detection of the type of the transfer media or from a type setting in a tray setting.

15. The sheet feeding apparatus according to claim 7, wherein the hardware processor is configured to make the warning via at least one of display and a sound.

16. The sheet feeding apparatus according to claim 1, wherein the type of the transfer media is at least one of a size, a basis weight, and a kind of medium of the transfer media.

17. The sheet feeding apparatus according to claim 1, wherein the hardware processor is configured to determine that the transfer medium is not overloaded and allow lifting of the transfer medium loading tray when the intermediate tray position detector detects that the vertical position of the transfer medium loading tray is not above the intermediate tray position and the overload detector does not detect, while the transfer medium loading tray is stationary at the position not above the intermediate tray position or while the transfer medium loading tray is being lowered from the position not above the intermediate tray position, the transfer media of the maximum loading amount.

18. An information processing apparatus configured to control a sheet feeding apparatus of an image forming apparatus configured to control vertical movement of a transfer medium loading tray that is movable vertically, the information processing apparatus comprising:

a receiver configured to receive results of detection by an overload detector configured to detect transfer media of a maximum loading amount prescribed for each type of the transfer media, results of detection by an intermediate tray position detector configured to detect the transfer medium loading tray being at an intermediate tray position prescribed for each type of the transfer media, and results of detection by a tray lower-end detector configured to detect the transfer medium loading tray being at a lower end position; and a hardware processor configured to control the vertical movement of the transfer medium loading tray in accordance with a type of the transfer media and on a basis of a vertical position of the transfer medium loading tray, the results of detection by the overload detector, and the results of detection by the intermediate tray position detector, and the hardware processor is configured to determine that the transfer medium is overloaded by detecting, using the intermediate tray position detector, that the vertical position of the transfer medium loading tray is not above the intermediate tray position, then lowering the transfer medium loading tray toward the lower end position, and detecting, by the overload detector, the transfer media of the maximum loading amount when the transfer medium loading tray reaches the lower end position.

19. An image forming system comprising:

the information processing apparatus according to claim 18;

an image forming unit configured to form an image;

the overload detector; and the intermediate tray position detector.

20. A non-transitory recording medium storing a computer readable program that causes a hardware processor of an image forming apparatus configured to control vertical movement of a transfer medium loading tray that is movable vertically to execute:

receiving results of detection by an overload detector configured to detect transfer media of a maximum loading amount prescribed for each type of the transfer media, results of detection by an intermediate tray position detector configured to detect the transfer medium loading tray being at an intermediate tray position prescribed for each type of the transfer media, and results of detection by a tray lower-end detector configured to detect the transfer medium loading tray being at a lower end position;

controlling the vertical movement of the transfer medium loading tray in accordance with a type of the transfer media and on a basis of a vertical position of the transfer medium loading tray, the results of detection by the overload detector, and the results of detection by the intermediate tray position detector; and determining that the transfer medium is overloaded by detecting, using the intermediate tray position detector, that the vertical position of the transfer medium loading tray is not above the intermediate tray position, then lowering the transfer medium loading tray toward the lower end position, and detecting, by the overload detector, the transfer media of the maximum loading amount when the transfer medium loading tray reaches is the lower end position.

* * * * *